United States Patent [19]
Gadbois et al.
[11] 4,358,504
[45] Nov. 9, 1982

[54] FLAME RETARDANT ACTIVATED CARBON WEB

[75] Inventors: Gerald W. Gadbois, Rochester, N.H.; Peter D. Sutherland, Ellington, Conn.

[73] Assignee: The Dexter Corporation, Windsor Locks, Conn.

[21] Appl. No.: 271,043

[22] Filed: Jun. 5, 1981

[51] Int. Cl.[3] ..... D04H 1/58
[52] U.S. Cl. ..... 428/288; 428/289; 428/408; 428/688; 428/921; 428/922
[58] Field of Search ..... 428/408, 921, 922, 288, 428/289, 688

[56] References Cited

U.S. PATENT DOCUMENTS 3,342,627 9/1967 Paxton et al. ..... 428/408
3,708,317 1/1973 Owen et al. ..... 428/408

*Primary Examiner*—Marion McCamish
*Attorney, Agent, or Firm*—Prutzman, Kalb, Chilton & Alix

[57] ABSTRACT

A fibrous web containing activated carbon is rendered flame retardant without substantially reducing its adsorption efficiency by treating the carbon containing web with about 5–20% by weight of a basic ammonium phosphate.

4 Claims, No Drawings

FLAME RETARDANT ACTIVATED CARBON WEB

DESCRIPTION

1. Technical Field

The present invention relates generally to fibrous web material containing activated carbon and is more particularly concerned with a new and improved flame retardant material containing a high content level of pulverized activated carbon.

2. Background Art

Heretofore it has been known that continuous web materials can be produced on papermaking machines containing a high level of pulverized activated carbon particles in order to impart to the sheet material the known characteristics of the activated carbon, particularly its adsorption characteristics. In this connection, reference may be made to Bodendorf et al U.S. Pat. No. 3,149,023 issued Sept. 15, 1964, and entitled "Carbon-Filled Sheet and Method for its Manufacture". Sheet material of this type containing activated carbon, when compared with similar material containing a corresponding amount of granular carbon, typically offers a lower air resistance, lower pressure drop and greater adsorption due to the substantially higher surface area associated with the activated carbon particles.

A major concern regarding both activated carbon and other carbon-containing papers is their flammable nature. This concern inhibits or prevents their use in situations where combustion can occur, such as filters in range hoods or as automobile air filters. Although such web material could be treated with a flame retardant in order to reduce this concern, it has been found that with materials containing activated carbon there is a severe drop in the adsorption efficiency when so treated. In many instances the efficiency drop is at least 40% or more, with some commercial materials resulting in an efficiency loss of 95%. Additionally, it has been found that when some flame retardants are added to the sheet material, problems are presented with respect to the decomposition of the binder used in the flame retardant composition. Additionally, it has been found that many flame retardants permit the sheet material to exhibit an after-glow for an appreciable period in addition to the undesirably excessive loss in adsorption efficiency.

DISCLOSURE OF INVENTION

In accordance with the present invention, it has been found that treatment of the activated carbon sheet with a selected flame retardant material will not only provide the beneficial flame retardant character so that no after-glow is exhibited, but also can be applied without destroying the adsorption characteristics of the sheet material and, in fact, without substantially reducing those characteristics. Additionally, in accordance with the present invention, it has been found that the selected flame retardant material provides an economic advantage over other well known flame retardant materials while at the same time permitting the retention of the desired activated carbon adsorption. Still further, it has been found that use of the selected flame retardant can be applied over a wide weight and porosity range for the sheet material treated and can be used with a large number of different types of activated carbon materials.

Other advantages will be in part obvious and in part pointed out more in detail hereinafter.

These and related features are achieved in accordance with the present invention by providing an activated carbon-containing fibrous web material that has been treated with up to about 20% by weight of a selected flame retardant composition consisting essentially of a basic ammonium phosphate, preferably diammonium phosphate.

A better understanding of the objects, advantages, features, properties and relationships of the invention will be obtained from the following detailed description which sets forth an illustrative embodiment and is indicative of the way in which the principles of the invention are employed.

DESCRIPTION OF A PREFERRED EMBODIMENT

Although it is possible to pretreat the activated carbon particles with the flame retardant prior to web or sheet formation, it is preferred, in accordance with the present invention, to treat the web material after it has been formed. This has the effect of applying the flame retardant material to both the fibrous component and the activated carbon component of the sheet material. Thus, it is preferred that the finely divided activated carbon particles be thoroughly mixed with the papermaking fibers in an aqueous dispersion and be formed into a continuous web using conventional papermaking techniques.

The various fibers used to form the sheet material may be natural cellulosic fibers, synthetic man-made fibers, or inorganic materials. In this connection the fibers set forth in the aforementioned U.S. Pat. No. 3,149,023 may be used in accordance with the present invention, as may the papermaking techniques described therein. Additionally, the finely powdered activated carbon particles set forth in the aforementioned patent may be used or the activated carbon may be formed from various materials, such as coconut shell, or may be a coal base material such as the metallic treated material sold under the name "Whetlerite". However, the present invention is not restricted to any particular type of activated carbon material and activated carbon from various sources may be employed effectively.

The activated carbon content of the sheet material may be in the range of about 15% to 80% by weight with the typical amount being in the range of 25% to 75% by weight and most sheets containing 40–50% by weight. As will be appreciated, the cationic binder material set forth in the aforementioned patent also may be effectively employed in preparing the sheet material. The resultant web can be prepared in such a way as to modify or control the basis weight and porosity of the end product in a manner well known in the art. In this connection, all of the disclosure contained within the aforementioned U.S. pat. No. 3,149,023 is incorporated herein by reference.

After the sheet material has been formed on the papermaking machine and has been dried, it is treated in accordance with the present invention with a solution of a basic ammonium phosphate. In this connection, only the monobasic and dibasic material have been found to achieve all of the flame retardant characteristics with the dibasic material being preferred. The solution may contain a small amount, e.g., up to about 1% by weight, of a wetting agent and typically has an ammonium phosphate concentration of up to about 30% with about 10–20% diammonium phosphate being preferred. This will provide a pick up of at least 5–20% by weight and preferably about 10–15%. The flame retardant solution is applied to the activated carbon-containing web material in such a manner as to completely saturate the web with the diammonium phosphate solution. The treated web is then squeezed and dried on conventional papermaking dryers. The resultant product typically shows a retention of at least 80–90% of the adsorption efficiency of the web material prior to treatment. Importantly, the treated material exhibits no afterglow whatsoever and excellent results in the open flame char test.

Two adsorption efficiency tests have been employed to test the sheet material treated in accordance with the present invention. These tests employ either hydrogen sulfide or butane to determine the adsorption capacity and are conducted as follows:

In the hydrogen sulfide test, air containing small quantities of hydrogen sulfide is fed from a gas cylinder through a small "Millipore" filter holder containing the test material. The hydrogen sulfide penetration through the media is detected by a mine safety appliance detector installed in the effluent or downstream side of the filter. That tube contains a reactive material that is discolored by the hydrogen sulfide, with the amount of discoloration being readily convertible to the amount of hydrogen sulfide within the stream. A flow meter within the line allows measurement and control of the air flow during each five minute test period.

In operating the test procedure, a test sample having a diameter of 2.2 cm. is inserted into the filter holder. The amount of hydrogen sulfide in the air stream is deliberately kept small at a level of approximately 200 parts per million. The test procedure consists of first running the air stream through the control filter to determine the hydrogen sulfide content and then switching the flow through the filter to be tested. After switching and prior to insertion of the detector tube in the effluent line, a short period, for example about 30 seconds, is allowed to assure a steady state condition in the system and to compensate for minor adjustments of flow rate, if necessary. The test is continued until the detector tube has been in the sample line for exactly five minutes. The tube is then withdrawn and compared to the detector tube for the control so that the amount of hydrogen sulfide in parts per million passing through the sample can be determined.

The adsorption capacity test for butane is also a measure of the adsorption efficiency of the activated carbon web material. A web containing a known content of activated carbon is saturated with butane gas. The weight difference before and after saturation is the amount of butane adsorbed.

In accordance with the test procedure, a 7 cm. diameter disk of a sample material is inserted into a sample holder and its initial weight is determined. Butane is passed through the sample material at a flow rate of about 250 milileters per minute for a period of approximately five minutes. The sample is weighed and reinserted into the sample holder for a second five minute butane gas treatment, after which is again weighed. The procedure is repeated until a constant weight is reached and the saturated weight of the material is recorded to determine the amount of butane gas adsorbed by the sample material.

An open flame char test is used to determine the flame resistance of the treated fibrous material and generally follows the procedure outlined in TAPPI T-461 entitled "Flammability of Treated Paper and Paperboard" and in ASTM D-777 entitled "Flammability of Treated Paper and Paperboard".

In accordance with the test procedure, a sample of the material to be tested is cut into a strip 7.5 cm. wide and 25 cm. long with the long dimension cut parallel to the machine direction of the paper. The sample is secured between a pair of metal clamps with the longitudinal axis of the material oriented in a vertical position and with the clamps gripping the sample along its longitudinal edges. The clamps cover approximately 1 cm. of its width on each edge on the sample material. A flame from a Bunsen burner is adjusted to a height of 4 cm. and the flame is applied to the center of the lower edge of the sample material at a level that will place the lower edge of the sample at a distance of 2 cm. from the top of the burner. The flame is applied to the sample for a period of 12 seconds and then withdrawn. The height of the charred portion of the material is measured with the charred height being determined by inserting a pointer from the bottom edge of the sample through the charred area until resistance is encountered. This distance is recorded as the char length. A char length of less than 10 cm. and preferably less than 7 cm. is desired.

The after-glow of the charred area is also observed and timed from the time the flame is removed. If any after-glow is present, the flame retardant is not considered satisfactory.

In order that the present invention may be more readily understood, it will be further described with reference to the following specific examples which are given by way of illustration only and are not intended to be a limit on the practice of the invention:

EXAMPLE I

A fibrous web material was prepared using activated carbon particles of the type designated "Whetlerite" at a basis weight of approximately 160 grams per square meter. The sheet material was dried and a portion thereof was saturated with a 10% solution of diammonium phosphate to provide a web material having a final basis weight after drying of 178 grams per square meter. The porosity of the material before and after treatment was tested along with the hydrogen sulfide adsorption efficiency. The after-glow of the material was determined along with the char height in accordance with the test procedures set forth hereinbefore. The properties of the material are reported in Table I.

TABLE I

| Property | Untreated | Treated With Flame Retardant |
|---|---|---|
| Basis Weight ($g/m^2$) | 160 | 178 |
| Porosity (l/min) | 534 | 450 |
| $H_2S$ Adsorption Efficiency (%) | 81 | 68 |
| Retained Adsorption Efficiency (%) | — | 84% |
| After-glow | Continuous | None |
| Char Height | Entire Length 25cm. | 4cm. |

EXAMPLE II–III

The procedure of Example I was repeated using a different activated carbon material, namely activated carbon made from coconut shell. Two web materials were formed using the same fiber dispersion, the resultant material having different basis weights and porosity levels. In this instance, the butane adsorption efficiency test was used to measure the effect of the flame retardant treatment and the test results are reported in Table II.

TABLE II

| PROPERTIES | SAMPLE 2 A | SAMPLE 2 B | SAMPLE 3 A | SAMPLE 3 B |
|---|---|---|---|---|
| Diammonium Phosphate (%) | None | 14% | None | 10% |
| Basis Weight ($g/m^2$) | 160 | 186 | 212 | 236 |
| Porosity (l/min) | 450 | 380 | 90 | 60 |
| Butane Adsorption (g/100g media) | 11.35 | 10.1 | 12.9 | 11.4 |
| Retained Adsorption (%) | — | 89 | — | 88 |
| After-Glow | Continuous | None | Continuous | None |
| Char Height | Entire Length | 4cm. | Entire Length | 1.5cm. |

As a comparison, when monobasic ammonium phosphate was employed in place of diammonium phosphate, the results were substantially the same except the char height was about 7 cm. When commercially available inorganic phosphate such as potassium phosphate and sodium phosphate were employed, it was found that the after-glow was continuous or for at least 10 seconds. When antimony halides and oxides were used the adsorption efficiency loss jumped to about 45 percent, while materials such as "Sunguard 131" (50% ammonium chloride and 50% dicyandiamide) and "duPont CM" (ammonium sulfanate) exhibited adsorption efficiency losses of 95% and 85%, respectively.

As will be apparent to persons skilled in the art, various modifications, adaptations and variations of the foregoing specific disclosure can be made without departing from the teachings of the present invention.

We claim:

1. A flame retardant activated carbon fibrous web material comprising a fibrous web containing at least 15 percent by weight activated carbon, said web being treated with a basic ammonium phosphate so as to retain at least about 5 percent by weight the phosphate based on the total weight of the web, the treated web being capable of retaining at least 80 percent of its adsorption efficiency and exhibiting a flame resistance of no afterglow and a char length of less than 10 cm. using test procedure TAPPI T-461.

2. The flame retardant material of claim 1 wherein the phosphate is diammonium phosphate and it is present at a retained level of up to 20 percent by weight.

3. The flame retardant material of claim 2 wherein the amount of phosphate is 10–15 percent by weight.

4. The flame retardant material of claims 1, 2 or 3 wherein the amount of activated carbon is 40–50 percent by weight.

* * * * *